US007036428B2

(12) United States Patent
Chapman

(10) Patent No.: US 7,036,428 B2
(45) Date of Patent: May 2, 2006

(54) APPARATUS AND METHOD FOR PRINTING CYLINDRICAL SURFACES

(75) Inventor: Andrew Jason Chapman, Hanover Park, IL (US)

(73) Assignee: Tampotech, Inc., Elgin, IL (US)

( * ) Notice: Subject to any disclaimer, the term of this patent is extended or adjusted under 35 U.S.C. 154(b) by 0 days.

(21) Appl. No.: 10/851,020

(22) Filed: May 21, 2004

(65) Prior Publication Data

US 2005/0257701 A1 Nov. 24, 2005

(51) Int. Cl.
*B41F 17/08* (2006.01)

(52) U.S. Cl. ..... 101/38.1; 101/35

(58) Field of Classification Search ..... 101/35
See application file for complete search history.

(56) References Cited

U.S. PATENT DOCUMENTS 3,835,773 A * 9/1974 Vasilantone ..... 101/122
5,423,252 A * 6/1995 Yamamoto et al. ..... 101/35
5,806,419 A * 9/1998 Adner et al. ..... 101/35
5,954,189 A * 9/1999 Averill ..... 198/803.5
6,035,779 A * 3/2000 Helms ..... 101/153
6,129,012 A * 10/2000 Dietz et al. ..... 101/41
6,276,266 B1 * 8/2001 Dietz et al. ..... 101/41

OTHER PUBLICATIONS

International Search Report, dated Nov. 1, 2005, for corresponding PCT Application No. PCT/US05/18155.

* cited by examiner

*Primary Examiner*—Anthony H. Nguyen
(74) *Attorney, Agent, or Firm*—Leydig, Voit & Mayer, Ltd

(57) ABSTRACT

A printing machine having a closed cup ink supply system for printing cylindrical items. The printing machine includes a printing module which comprises a housing, a pair of pulleys rotatably supported by the housing and endless metal band disposed about the pulleys and having an etched printing image ink receiving area on an outer surface thereof, and an ink cup having an open bottom positioned on a flat section of said endless band. The printing module is mountable onto a drive shaft of the printing machine, which is operable for driving one of the pulleys of the module and moving the band past an underside of ink cup such that ink is supplied to the etched printing image ink receiving area for transfer to a transfer cylinder in contacting relation to the band at a location remote from the ink cup.

23 Claims, 4 Drawing Sheets

APPARATUS AND METHOD FOR PRINTING CYLINDRICAL SURFACES

FIELD OF THE INVENTION

The present invention relates generally to printing machines, and more particularly, to printing machines adapted for printing cylindrical surfaces.

BACKGROUND OF THE INVENTION

Gravure rotary printing machines are known for printing cylindrical surfaces. Such printing machines typically have a solid metal printing cylinder with an etched outer surface that receives ink and transfers an ink pattern, as determined by the etching, to a silicon coated transfer cylinder, which in turn applies the image to the outer surface of a rotatably supported cylindrical item or the like to be printed. For supplying ink to the gravure cylinder, ink is continuously pumped from an ink supply to a doctor assembly which applies ink to the etched surface of the gravure cylinder, while doctoring excessive ink for return to the ink supply and ultimate recirculation to the doctor assembly. By reason of the required recirculation of the ink during a printing operation, the ink continuously evaporates, causing the escape of noxious fumes into the environment potentially harmful to workers. Due to such evaporation, the viscosity of the ink in the ink supply must be monitored and solvent must be periodically added to the ink to maintain proper viscosity. The ink recirculation also can be messy, sometimes causing ink splattering within the work environment. Since the etched gravure cylinder is made of solid metal, it further is expensive and significantly adds to the cost of the printing machine.

OBJECTS AND SUMMARY OF THE INVENTION

It is the object of the present invention to provide a machine for printing cylindrical items in which the ink supply is protectively enclosed from the environment of the workers and does not release harmful fumes.

Another object is to provide a printing machine as characterized which eliminates the need for monitoring ink viscosity or the addition of solvents to the printing ink during operation, A further object is to provide a printing machine of the foregoing type that is economical in construction and more efficient in operation. A related object to provide such a printing machine which eliminates the necessity for costly gravure printing cylinders and ink transfer pumps.

Still another object is to provide a printing module for a printing machine of the above kind that enables easy field modification of conventional gravure printing machines for operation in accordance with the invention.

Other objects and advantages of the invention will become apparent upon reading the following detailed description and upon reference to the drawings, in which:

Figures 1, 2:
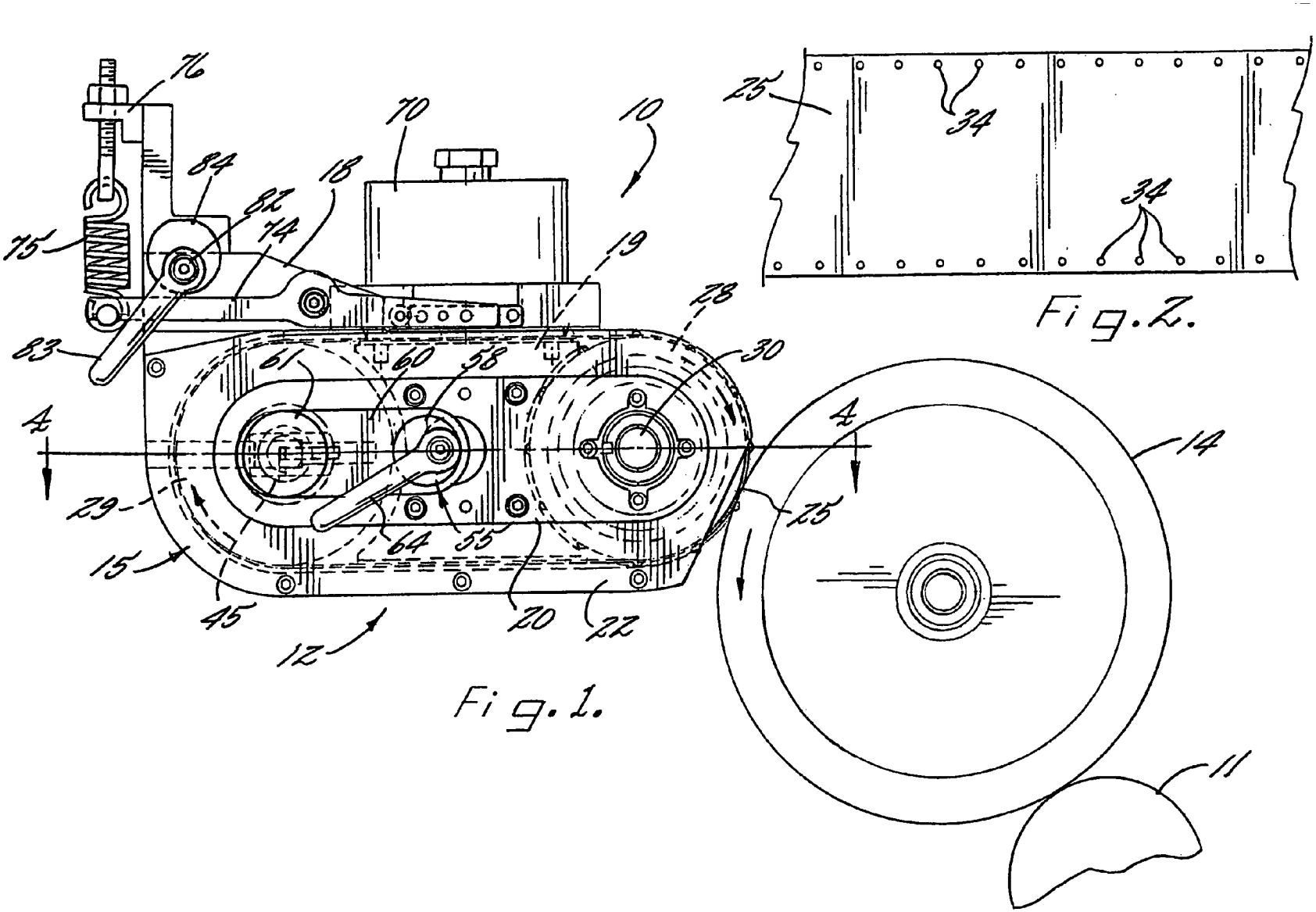
FIG. 1 is a side elevational view of a printing machine in accordance with the invention.
FIG. 2 is an enlarged partial plan view of the endless metal ink transfer band of the illustrated printing machine.
Figure 3:
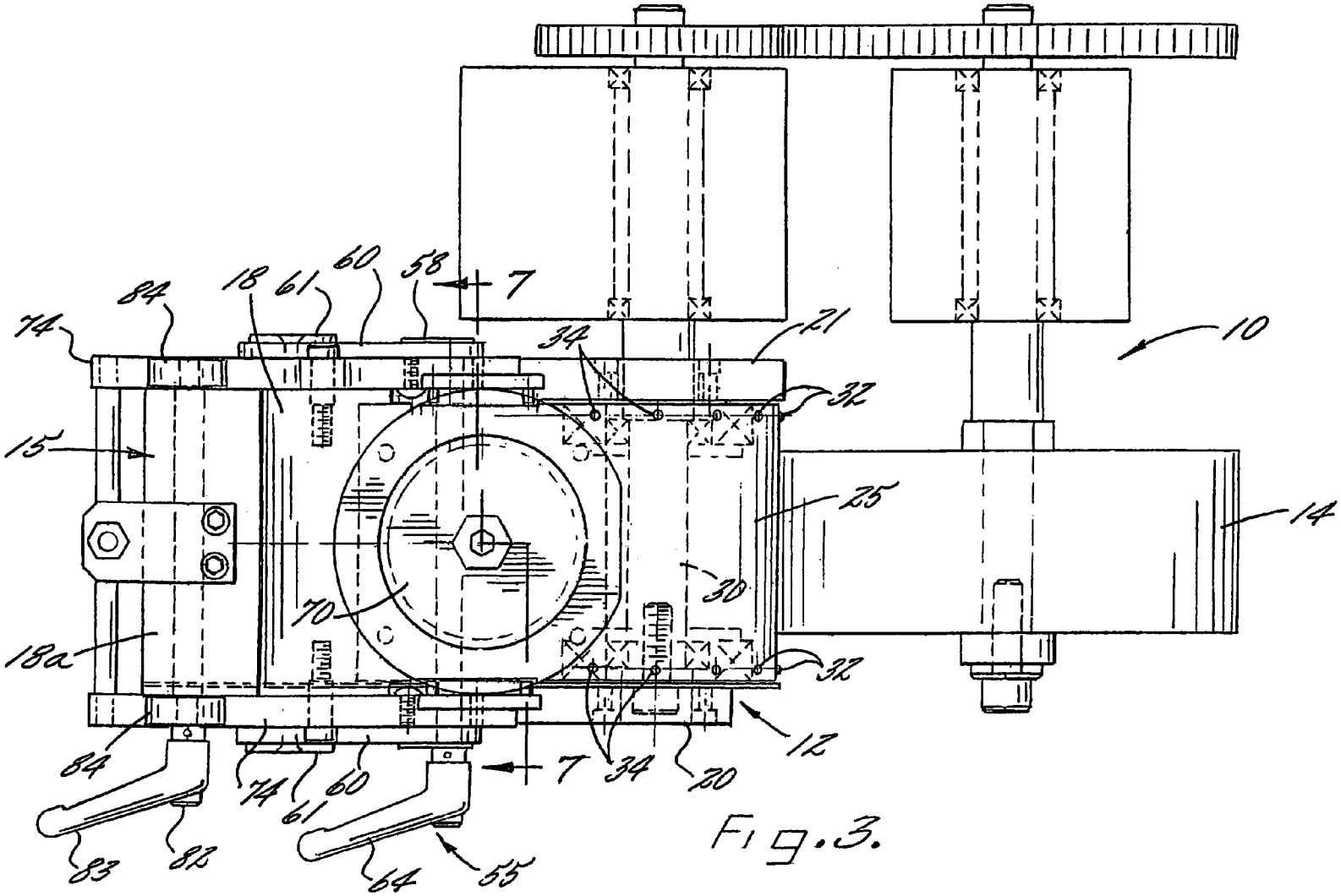
FIG. 3 is a top plan view of the printing machine shown in FIG. 1.
Figure 4:
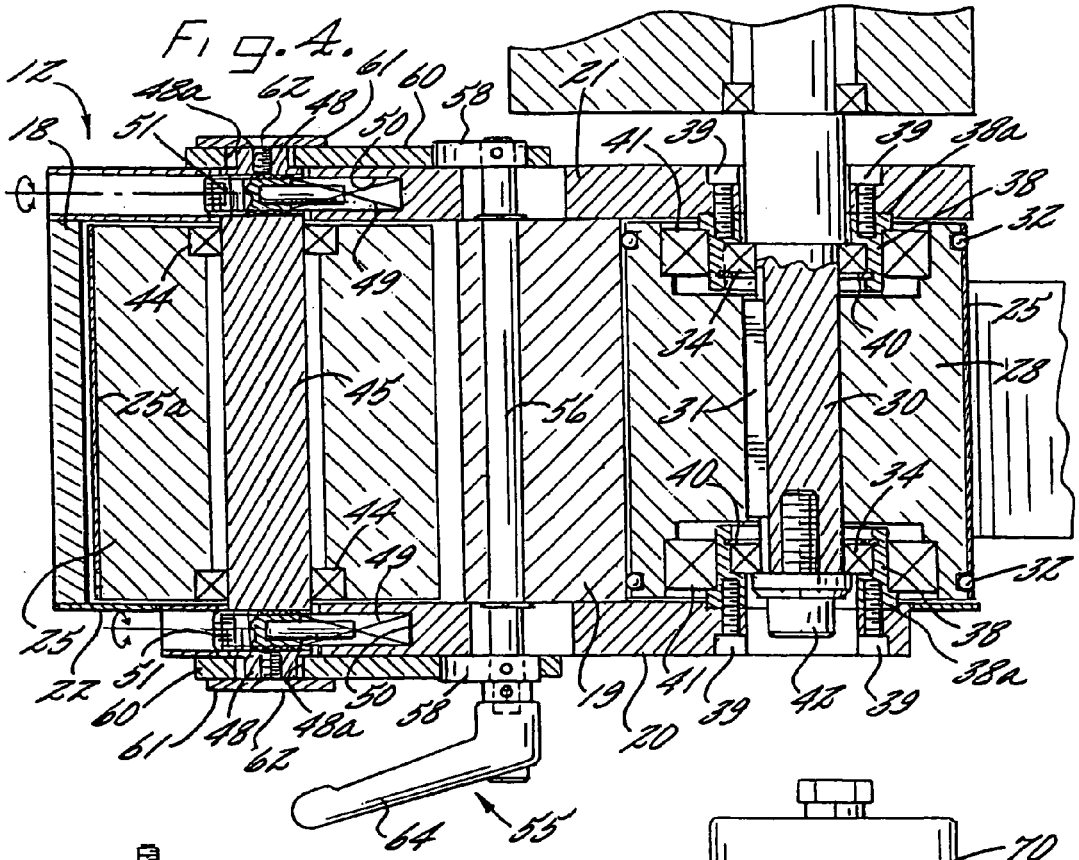
FIG. 4 is an enlarged vertical section of the printing module of the illustrated machine, taken in the plane of line 4—4 in FIG. 1.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF PREFERRED EMBODIMENT

Referring now more particularly to the drawings, there is shown an illustrative printing machine 10 adapted for applying printed images onto cylindrical surfaces, such as the outer surface of a cylindrical item 11. The illustrated machine 10 includes a printing module 12 for applying an ink image to a transfer cylinder 14 having an outer surface, preferably made of silicon, which receives inked images from the printing module 12 for transfer to the outer surface of the cylindrical item 11.

In accordance with the invention, the printing module includes a contained ink supply system for supplying ink to a continuously moving flexible band which, in turn, transfers ink images to the transfer cylinder. The printing module 12 in this case has a multi-part housing 15 comprising central housing body members 18, 19 and front and rear side plates 20, 21 bolted to the body members 18, 19 for tying the body members 18, 19 into a unitary housing structure. The illustrated printing module 12 has a cover plate 22 secured about the front side plate 20 for further enclosing the front side of the housing 15.

In carrying out the invention, the module 12 has an endless ink receiving and transfer band or belt 25 disposed for movement about a pair of laterally spaced pulleys, which in this case comprises a drive pulley or sprocket 28 and a take-up pulley 29. The pulleys 28, 29 are supported by the housing 15 in laterally spaced relation so that the band 25 defines semi-circular end sections 25*a*, 25*b* and substantially flat horizontal upper and lower sections 25*c*, 25*d*. The central housing body member 18 in this instance is cradle shaped having an upstanding side 18*a*, disposed on the left-hand side thereof as viewed in FIG. 5, and a horizontal leg 18*b* extending below the pulleys 28, 29. The upstanding side 18*a* is formed with an inner arcuate surface in spaced relation about the adjacent take-up pulley 29. The central body member 19 is disposed between the pulleys 28, 29 and has arcuate lateral sides each adjacent a respective one of the pulleys 28, 29.

The band 25 is preferably made of metal, such as stainless steel, and has a laser finished joint so as to provide a continuous smooth outer surface. The band 25 has an etched ink receiving outer area, preferably formed by laser etching, for receiving a predetermined ink image for transfer to the transfer cylinder 14 as an incident to movement of the endless band 25 about the pulleys 28, 29.

For rotatably driving the drive pulley 28, the drive pulley 28 is mounted on a drive shaft 30, which may be driven in a conventional manner from the main drive of the printing machine 10. The drive pulley 28 in this case has a drive key 31 press fit within a central bore thereof for receipt within a keyway in the drive shaft 30.

To facilitate positive driving movement of the band 25 as an incident to rotary movement of the drive pulley 28, the drive pulley 28 has a plurality of circumferentially spaced sprockets, which in this case are in the form of balls 32 adjacent opposite axial ends thereof protruding at circumferentially spaced points from an outer surface of the drive pulley 28. The balls 32 of the drive pulley 28 sequentially engage respective apertures 34 in opposite sides of the band 25 to effect movement of the band about the pulleys 28, 29 when the drive pulley 28 is driven.

In keeping with the invention, in order to permit removal and replacement of the printing module 12 on the drive shaft 30 and to facilitate tensioning and untensioning of the band 25, the drive pulley 28 is supported on the drive shaft 30 by a concentric double bearing arrangement. First, the drive shaft 30 is supported by a pair of bearing sets 34 each supported within respective stationery sleeve or hub 38 fixed to a respective housing plate 20, 21 by bolts 39. The bearing sets 34 are axially retained by an internal shoulder of the respective hub 38 and a snap ring 40 fixed within the hub 38. Secondly, relatively larger bearing sets 41 support the drive pulley 28 for rotation relative to the fixed bearing hubs 38. The second bearing sets 41 each are axially retained by a respective shoulder in the drive pulley 28 and an outwardly extending radial lip 38*a* of the bearing hub 38. To retain the module 12 in position on the drive shaft 30, a retaining bolt 42 having a head overlying the forward inner bearing set 34 is screwed into the front axial end of the drive shaft 30. The take-up pulley 29 in this case is supported by bearings 44 for rotation about a stationery shaft 45 fixed between the forward and rearward housing plates 20, 21.

In order to selectively tension the band 25, the take-up pulley 29 is laterally positionable relative to the drive pulley 28. To this end, opposite axial ends of the take-up pulley shaft 45 are formed with horizontal flats 48, which are positionable within horizontally extending rectangular slots 48*a* in the front and rear side plates 20, 21. Compression springs 49 are disposed within pockets 50 of the side plates 20, 21, each being interposed between a blind side of the pocket 50 and a set screw 51 threadedly extending horizontally through a respective axial end of take-up pulley shaft 45. For establishing the desired tension on the ink transfer band 25, the set screws 51 can be selectively adjusted. Advancement of the set screws 51 into and through the take-up pulley shaft 45 against the compression springs 49 increases the opposite biasing force on the shaft 45 and the resulting tension on the band 25. Opposite rotation of the set screws 51, i.e. in a retracting direction, reduces the compression of the springs 49 and reduces tension force on the band 25.

To overcome the force of the compression springs 49 on the band in order to permit band removal and replacement, a crank mechanism 55 is provided. The crank mechanism 55 includes a crank shaft 56 rotatably supported between the front and rear side plates 20,21 at a location between the pulleys 28, 29. The crankshaft 56 carries eccentrically mounted cams 58 at its opposite ends, which each are disposed within a respective circular camming receiving aperture in one end of an elongated cam plate 60, the other end of which is formed with an elongated take-up pulley shaft receiving slot. Cam plate retaining washers 61 and screws 62 retain the cam plates 60 on the take-up pulley shaft, while permitting relative lateral movement.

Figure 5:
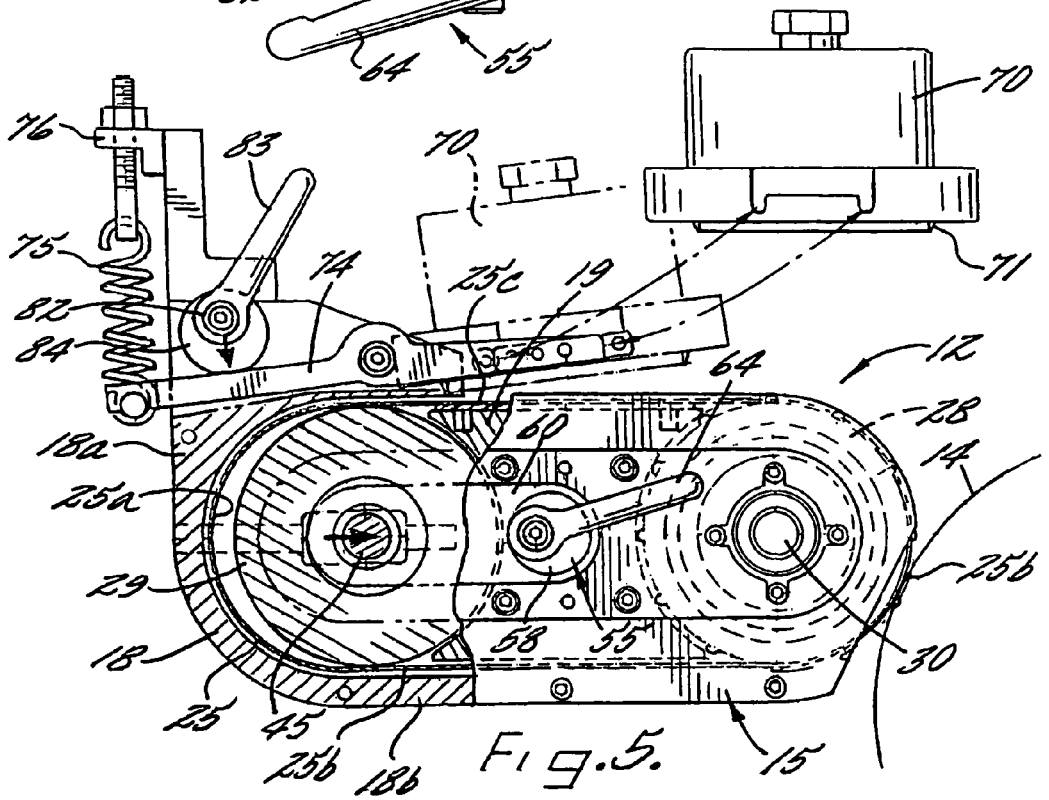
FIG. 5 is a side elevational view, in partial section, of the printing module of the illustrated printing machine, illustrating replacement of the ink supply cup thereof.
Figure 6:
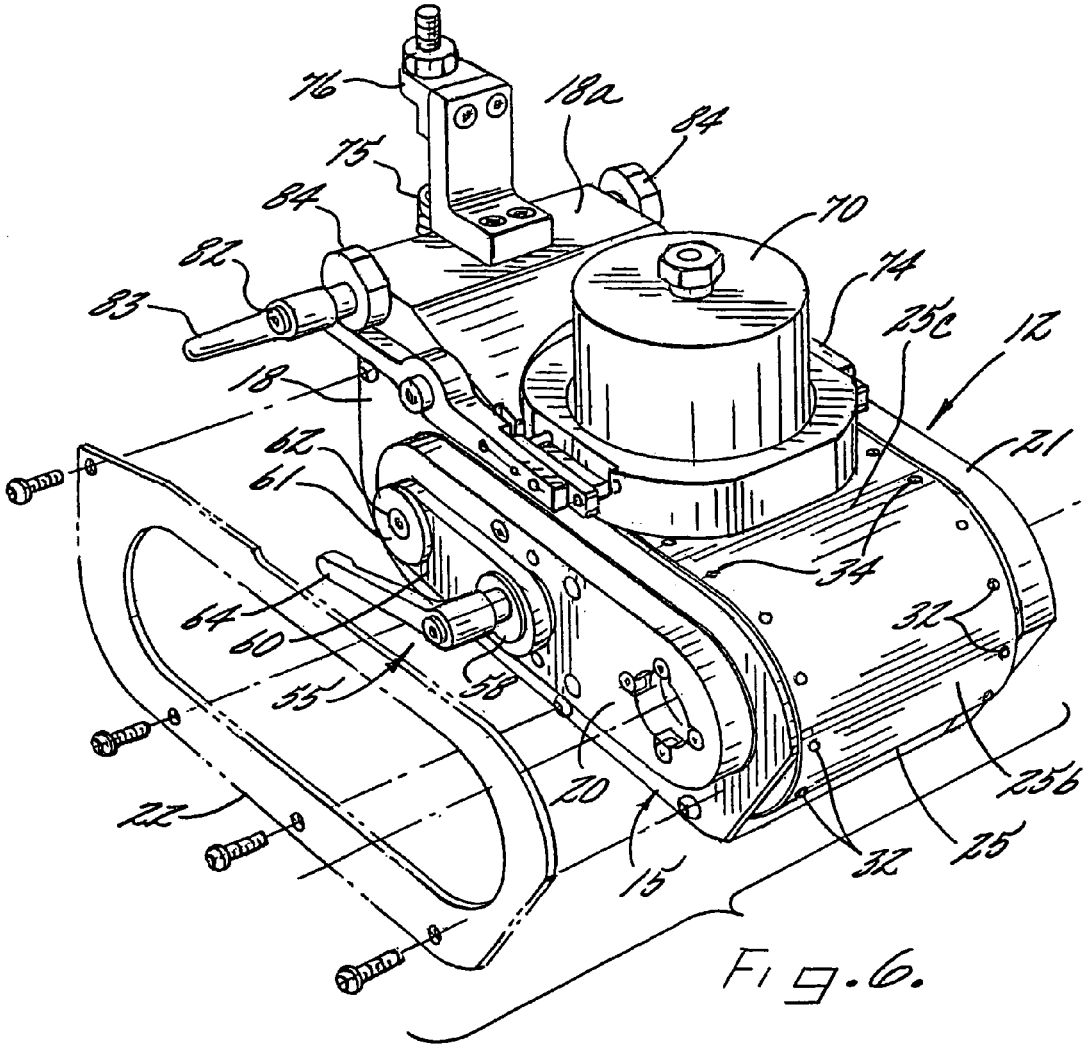
FIG. 6 is a perspective of the printing module of the illustrated printing machine, depicting removal of a front housing cover plate.
Figure 7:
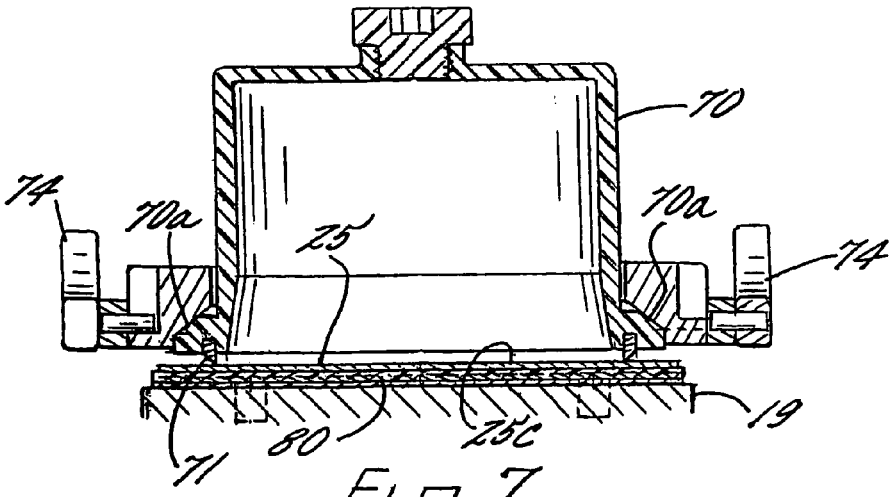
FIG. 7 is an enlarged vertical section of the ink supply cup for the printing module of the illustrated printing machine.

Rotation of the crank shaft 56 in a clockwise direction, as viewed in FIG. 5, by a crank arm 64 fixed to a forward end thereof, rotates the eccentric cams 58 such that the cam plates 60 laterally move to the right, as viewed in FIG. 5, drawing the idler pulley shaft 45 to the right and compressing the springs 49 sufficient to relieve tension on the band, thereby enabling removal and replacement of the band 25 as required. Rotation of the crank arm 64, and hence the eccentric cams 58, in the opposite direction, enables the compression springs 49 to again bias the take-up pulley shaft 45 to the desired band tensioning position.

In carrying out a further feature of the invention, for supplying ink to the moving band 25, an inverted ink supply cup 70 is positioned on the upper horizontal section 25*c* of the band 25 at a location between the drive and take-up pulleys 28, 29. The ink cup 70 may be of a conventional type used in pad printing machines, which comprises a molded plastic reservoir body with an open lower end and a separate annular doctor blade 71 bonded in the lower end of the body around its opening. The open bottom of the cup 70 provides free access of ink to the upper horizontal surface 25*c* of the band 25 and the doctor blade 71 defines a sealing and doctoring lower end. Hence, as the band 25 is moved past the underside of the ink cup 70, ink is supplied to the engraved image on the band and is simultaneously doctored by the blade 71.

For maintaining the ink cup 70 in position on the moving band 25, a cup hold-down mechanism is provided which includes a pair of arms 74 pivotally supported on an upstanding upper portion of the central housing body 18. Outer free ends of the arms 74 pivotally engage diametrically opposed front and rear sides of a lower ink cup flange 70*a*. For biasing the arms 74 in a cup hold position, a spring 75 is connected between opposite rearward ends of the arms 74 and an upstanding bracket 76 supported by the central housing body member 18.

For supporting the underside of the band 25 at the location of the ink cup 70, a bearing plate 80 is fixed to the central housing body member 19 immediately below the upper horizontal section 25*c* of the band 25. To facilitate relative movement between the band 25 over the bearing plate 80 and to facilitate the sealing contact between the ink cup 70 on the moving band 25, the bearing plate 80 preferably is formed of a laminate plastic material, or a metal plate with an upper plastic, preferably teflon, laminate or coating.

To permit removal and replacement of the ink cup 70, the ink cup hold-down arms 74 are pivotable in a counter-clockwise direction as depicted in FIG. 5. To facilitate such pivotal movement, a crank shaft 82, rotatable by a crank arm 83, is mounted on the housing body member 18. The crank shaft 82 carries eccentrically mounted cams 84 which as an incident to counter-clockwise rotation of the crank arm 83, force the pivot arms 74 downwardly to overcome the biasing force of the spring 75, thereby lifting the opposite ends of the arms 74, as depicted in FIG. 5, to a position that permits removal and replacement of the ink cup 70.

In operation of the printing machine 10, it can be seen that with the ink cup 70 in its hold-down position on the horizontal section 25*c* of the moving band 25, ink will be doctored onto the etching on the band and the ink image will be transferred to the transfer cylinder 14, and in turn, onto the cylindrical item 11. The ink supply is protectively contained and enclosed from the environment of workers around the machine during the printing operation. Likewise, no evaporation of ink from the ink supply will occur, eliminating the necessity for monitoring ink viscosity or adding solvents to the printing ink during printing. The printing machine further is economical in construction by eliminating the necessity for costly gravure printing cylinders and ink transfer pumps typical of the prior art gravure printing machines. The printing module 12 of the machine further is adapted for easy field modification, with the module 12 being readily positionable onto the drive shaft 30 of conventional printing machines in place of the gravure printing cylinder.

What is claimed is:

1. A printing machine for printing cylindrical surfaces comprising:

a printing unit having an endless band disposed about a pair of pulleys such that said band defines an upper substantially flat band section between said pulleys;

a housing supporting said pulleys for relative rotational movement;

said band having an etched printing image ink receiving area on an outer surface thereof;

an ink cup having an open bottom surrounded by a doctor blade positioned on said flat band section; and a drive for rotatably driving at least one of said pulleys for moving said band about said pulleys and past an underside of said ink cup such that ink is supplied to the etched printing image ink receiving area of the band for transfer to a cylindrical surface in contacting relation to an outer surface of said band at a location remote for said ink cup.

2. The printing machine of claim 1 including a transfer cylinder in contacting relation to said band for receiving a printing ink image from said printing image ink receiving area of said band as an incident to movement of the band about said pulleys.

3. The printing machine of claim 2 in which said pulleys are disposed in laterally spaced relation to each other, said band defining semi-cylindrical band sections about each of said pulleys, and said transfer cylinder is disposed in contacting relation to one of said semi-cylindrical band sections.

4. The printing machine of claim 1 in which said pulleys comprise a drive pulley mounted on a power driven shaft of said printing machine and a take-up pulley mounted on a non-power driven shaft.

5. The printing machine of claim 4 in which said take-up pulley is laterally positionable with respect to said drive pulley for desired tensioning said band.

6. The printing machine of claim 4 in which said drive pulley is supported for rotation relative to said housing by a plurality of different diameter bearing sets including first relatively small diameter bearing sets each directly supporting the drive shaft and being retained within a respective annular hub fixed to said housing, and a second relatively larger diameter bearing sets each being disposed in interposed relation between an exterior annular surface of a respective fixed hub and an internal annular surface of the drive pulley.

7. The printing machine of claim 4 in which said take-up pulley shaft is non-rotatably supported within said housing, said take-up pulley being mounted for relative rotation on said take-up pulley shaft, and biasing springs interposed between said take-up pulley shaft and said housing for biasing the take-up pulley shaft and the take-up pulley mounted thereon in a direction away from the drive pulley for tensioning said endless band.

8. The printing machine of claim 7 including a crank mechanism for moving said take-up pulley shaft and the take-up pulley mounted thereon laterally in a direction toward said drive shaft for compressing said biasing springs and relieving tension on said band sufficient to permit removal and replacement of the band on the drive and take-up pulleys.

9. The printing machine of claim 8 in which said crank mechanism includes a crank shaft rotatably supported by said housing, a crank arm fixed to said crank shaft for rotation of said crankshaft, a cam plate having a transversely oriented elongated opening for receiving an end of the take-up pulley shaft, and a cam mounted on said crank shaft within a cam aperture of said cam plate such that rotational movement of said crank arm and crank shaft in one direction causes said cam to draw said cam plate in a direction that moves said take-up pulley shaft and take-up pulley against the force of said biasing springs to relieve band tension.

10. The printing machine of claim 1 including a biasing mechanism for urging said ink cup downwardly against said flat band section, and a back-up plate mounted on an underside of said band flat section for supporting the band against the biasing force of said ink cup.

11. The printing machine of claim 9 in which said backup plate is made of a plastic laminate material to facilitate movement of said band across said backup plate.

12. The printing machine of claim 10 in which said biasing mechanism includes a pair of hold-down arms mounted for pivotable movement on said housing, said hold-down arms having a first ends removably engageable with said ink cup and a biasing spring fixed between a second ends of said arms and said housing for biasing the first ends of said hold-down arms in a downward hold-down position.

13. The printing machine of claim 12 in which said hold-down mechanism includes a crank mechanism operable for depressing said second ends of said hold-down arms in a direction against the biasing force of said spring for pivoting the first ends of said hold-down arms upwardly to a position that permits removable and replacement of said ink cup.

14. The printing machine of claim 1 in which said drive pulley has a plurality of circumferentially spaced sprocket members adjacent opposite axial ends thereof, and said band is formed with a plurality of sprocket-receiving apertures successively engageable by the drive pulley sprockets during driving movement of the drive pulley.

15. The printing machine of claim 14 in which said sprockets are balls mounted in partially protruding fashion from an outer cylindrical surface of said drive pulley.

16. The printing machine of claim 4 in which said housing, pulleys, and band, comprise a module removably positionable on the power driven shaft of said printing machine.

17. The printing machine of claim 16 in which said module is removably retained on said power driven shaft by a fastener releasably engageable with an outer axial end of said power driven shaft.

18. A printing module for removable mounting onto a drive shaft of a printing machine comprising:

a housing supporting a pair of pulleys for relative rotational movement, an endless band disposed about said pulleys such that the band defines an upper substantially flat band section between said pulleys;

said band having an etched printing image ink receiving area on an outer surface thereof;

an ink cup having an open bottom surrounded by a doctor blade positioned on said flat band section; and one of said pulleys being removably mounted on and rotatably drivable by said drive shaft for moving said band about said pulleys and past an underside of said ink cup such that ink is supplied to the etched printing image ink receiving area of the band for transfer to a transfer cylinder of the printing machine in contacting relation to an outer surface of said band at a location remote from said ink cup.

19. The printing machine of claim 18 in which the other of said pulleys is mounted on a non-power driven shaft.

20. The printing machine of claim 19 in which said other pulley is laterally positionable with respect to said one pulley for desired tensioning of said band.

21. The printing machine of claim 19 in which said non-power driven shaft is fixed against rotation in said housing, said other pulley being mounted for relative rotation on said non-power driven shaft, and biasing springs interposed between said non-power driven shaft and said housing for biasing the non-power driven shaft and the other pulley mounted thereon in a direction away from the one pulley for tensioning said endless band.

22. The printing machine of claim 18 including a biasing mechanism for urging said ink cup downwardly against said flat band section, and a back-up plate mounted on an underside of said band flat section for supporting the band against the biasing force of said ink cup.

23. The printing machine of claim 18 in which said one pulley has a plurality of circumferentially spaced sprocket members adjacent opposite axial ends thereof, and said band is formed with a plurality of sprocket-receiving apertures successively engageable by the pulley sprockets during driving movement of the one pulley.

* * * * *